US008075321B1

(12) United States Patent
Costello et al.

(10) Patent No.: US 8,075,321 B1
(45) Date of Patent: Dec. 13, 2011

(54) ELECTRICAL CONNECTOR FOR MOUNTING A RIBBON CABLE ON A PRINTED CIRCUIT BOARD

(75) Inventors: Brian Patrick Costello, Scotts Valley, CA (US); James Lee Fedder, Etters, PA (US); Matthew Sypolt, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/787,882

(22) Filed: May 26, 2010

(51) Int. Cl.
*H01R 12/00* (2006.01)

(52) U.S. Cl. ..... 439/77

(58) Field of Classification Search ..... 439/77, 439/492, 494, 497, 751
See application file for complete search history.

(56) References Cited

U.S. PATENT DOCUMENTS 4,235,500 A * 11/1980 Belopavlovich et al. ..... 439/495
4,784,613 A 11/1988 Deisch
4,902,236 A 2/1990 Hasircoglu
6,299,469 B1 * 10/2001 Glovatsky et al. ..... 439/329
6,386,918 B1 * 5/2002 Zheng et al. ..... 439/607.45
7,223,105 B2 * 5/2007 Weiss et al. ..... 439/66
2006/0264076 A1 * 11/2006 Chen ..... 439/82

OTHER PUBLICATIONS

Tyco Electronics Part No. 111039-1, 10 Paddleboard Assy W/Cover , Tyco copyright.

* cited by examiner

*Primary Examiner* — Tulsidas C Patel
*Assistant Examiner* — Harshad Patel

(57) ABSTRACT

A connector and cable assembly is provided for mounting on a printed circuit board. The assembly includes a ribbon cable having an end that includes an electrical conductor. The assembly also includes an electrical connector that includes a dielectric body comprising a circuit side, a cable side that is opposite the circuit side, and a contact opening that extends through the body. The electrical connector also includes an electrical contact having a cable segment and a tail extending from the cable segment. The electrical contact is held within the contact opening such that at least a portion of the cable segment extends along the cable side of the body and at least a portion of the tail projects from the circuit side of the body. The cable segment is electrically connected to the electrical conductor of the ribbon cable. The tail is configured to be separably mated with the printed circuit board.

19 Claims, 8 Drawing Sheets

ELECTRICAL CONNECTOR FOR MOUNTING A RIBBON CABLE ON A PRINTED CIRCUIT BOARD

BACKGROUND OF THE INVENTION

The subject matter described and/or illustrated herein relates generally to electrical connectors, and more particularly, to electrical connectors that terminate ribbon cables to printed circuit boards.

In electronic systems that include printed circuit boards (sometimes referred to as "circuit boards"), ribbon cables are sometimes used to electrically connect a printed circuit board to another component. For example, ribbon cables may be used to electrically connect the printed circuit board to another printed circuit board and/or to supply the printed circuit board with electrical power from an electrical power source. Traditional ribbon cables include insulated cylindrical wires that are aligned in a row and connected together at the insulation layers to define the ribbon structure of the cable. Many electronic systems currently use miniaturized forms of traditional ribbon cables, which are commonly referred to as "flat flexible cables", "flat flex circuits", "flat flexible conductor cables", "flex cables", "flex circuits", and "flexible flat cables".

Ribbon cables are electrically connected to printed circuit boards in a variety of manners. Some ribbon cables are permanently connected to a printed circuit board by soldering exposed electrical conductors of the ribbon cable directly to electrical contacts of the printed circuit board. But, such permanent connections may be undesirable. For example, if the ribbon cable fails, the printed circuit board may be scrapped along with the ribbon cable, or vice versa, because of the difficulty of disconnecting the ribbon cable from the printed circuit board. Moreover, it may be necessary to connect the ribbon cable to the printed circuit board before the printed circuit board is installed in a larger system because of a limited amount of space within the system available to perform the soldering operation. Connecting the ribbon cable to the printed circuit board before installation may make it more difficult to install the printed circuit board or other components of the larger system.

Some known ribbon cables are electrically connected to a printed circuit board using electrical connector systems that provide a separable connection between the ribbon cable and the printed circuit board. For example, such electrical connector systems may include a connector mounted on the printed circuit board and another connector that terminates an end of the ribbon cable. Electrical contacts of the connectors mate together to electrically connect the ribbon cable to the printed circuit board. But, such electrical connector systems may be larger than is desired. For example, the demand for smaller and smaller electronic devices may result in less available space within the device to accommodate the printed circuit board and the various connections thereto. Accordingly, there may be less space available for accommodating both the connector mounted on the printed circuit board and the connector that terminates the ribbon cable.

BRIEF DESCRIPTION OF THE INVENTION

In one embodiment, a connector and cable assembly is provided for mounting on a printed circuit board. The assembly includes a ribbon cable having an end that includes an electrical conductor. The assembly also includes an electrical connector that includes a dielectric body comprising a circuit side, a cable side that is opposite the circuit side, and a contact opening that extends through the body. The electrical connector also includes an electrical contact having a cable segment and a tail extending from the cable segment. The electrical contact is held within the contact opening such that at least a portion of the cable segment extends along the cable side of the body and at least a portion of the tail projects from the circuit side of the body. The cable segment is electrically connected to the electrical conductor of the ribbon cable. The tail is configured to be separably mated with the printed circuit board.

In another embodiment, a printed circuit board and cable assembly includes a printed circuit board, a ribbon cable having an end that includes an electrical conductor, and an electrical connector. The electrical connector includes a dielectric body comprising a circuit side, a cable side that is opposite the circuit side, and a contact opening that extends through the body. The end of the ribbon cable is mounted on the cable side of the body. The body is mounted on the printed circuit board at the circuit side. The electrical connector also includes an electrical contact held within the contact opening of the body. The electrical contact includes a cable segment and a tail extending from the cable segment. The cable segment is electrically connected to the electrical conductor of the ribbon cable. The tail is separably mated with the printed circuit board.

In another embodiment, a printed circuit board and cable assembly is provided. The assembly includes a printed circuit board comprising a via, a ribbon cable having an end, and an electrical connector terminating the ribbon cable to the printed circuit board. The electrical connector includes an at least partially dielectric body and an electrical contact. The body extends between the end of the flex cable and the printed circuit board. The electrical contact is soldered to the ribbon cable and press-fit into the via of the printed circuit board for electrically connecting the ribbon cable to the printed circuit board.

DETAILED DESCRIPTION OF THE INVENTION

Figure 1:
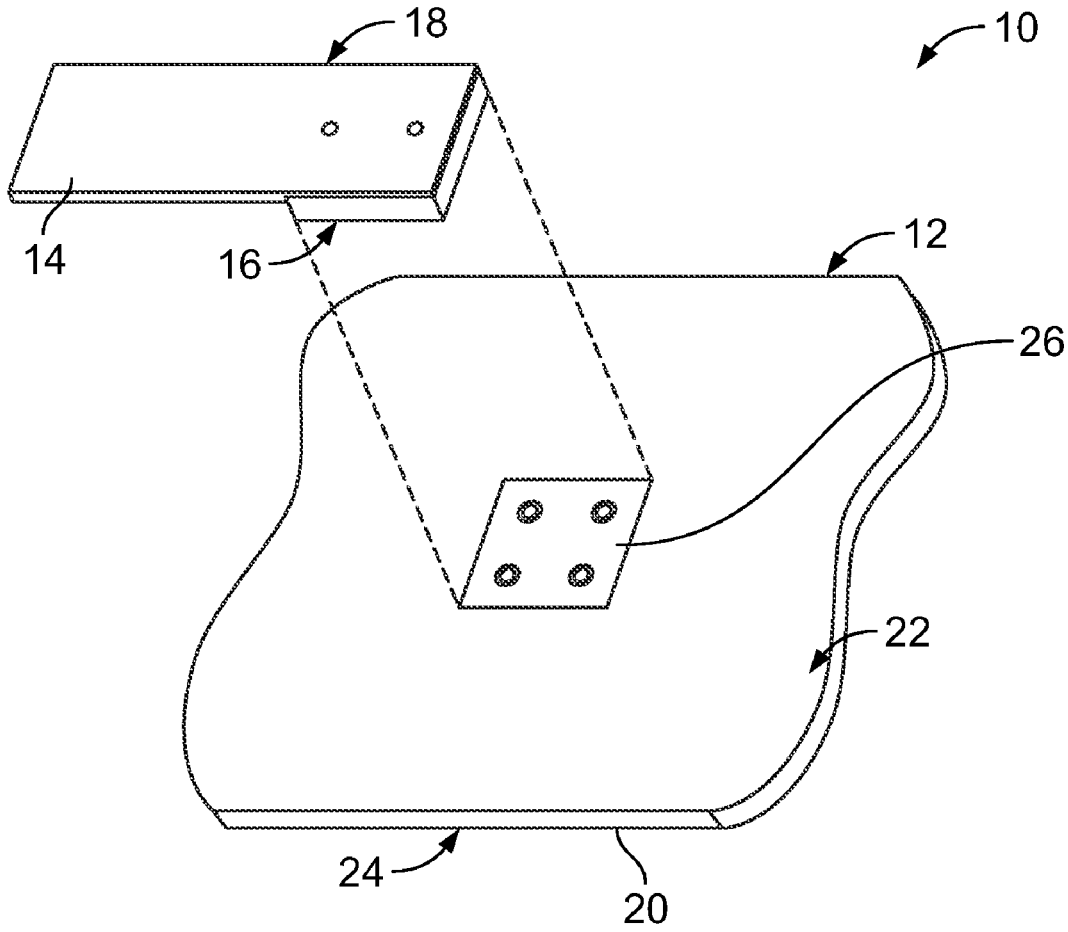
FIG. 1 is a partially exploded view of an exemplary embodiment of a printed circuit board and cable assembly.

FIG. 1 is a partially exploded perspective view of an exemplary embodiment of a printed circuit board and cable assembly 10. The assembly 10 includes a printed circuit board 12, a ribbon cable 14, and an electrical connector 16. The ribbon cable 14 includes an end 18, which is terminated to the electrical connector 16. As will be described below, the electrical connector 16 is configured to be separably mated directly with the printed circuit board 12 to establish an electrical connection between the ribbon cable 14 and the printed circuit board 12. The electrical connector 16 thereby enables the ribbon cable 14 to be mounted on the printed circuit board 12 in electrical connection therewith out the use of a complementary connector on the printed circuit board 12. An assembly of the ribbon cable 14 and the electrical connector 16 may be referred to herein as a "connector and cable assembly."

The printed circuit board 12 includes a substrate 20 having a pair of opposite sides 22 and 24. The ribbon cable 14 mounts onto the side 22 of the substrate 20. The printed circuit board 12 includes one or more electrically conductive vias 26 that extend into the side 22 of the substrate 20. The vias 26 are electrically connected to electrical circuits (not shown) of the printed circuit board 12, electrical components (not shown) of the printed circuit board 12, and/or the like. Each via 26 receives a tail 60 (FIGS. 4-6 and 9) of a corresponding electrical contact 28 (FIGS. 3-9) of the electrical connector 16 therein to electrically connect the ribbon cable 14 to the electrical circuits, the electrical components, and/or the like of the printed circuit board 12. In the exemplary embodiment, the printed circuit board 12 includes four vias 26 for receiving four electrical contacts 28 of the electrical connector 16. But, the printed circuit board 12 may include any number of the vias 26 for receiving any number of electrical contacts 28 of the electrical connector 16. Each via 26 may extend completely through the substrate 20 or may extend into the side 22 only partially through the substrate 20.

Figure 2:
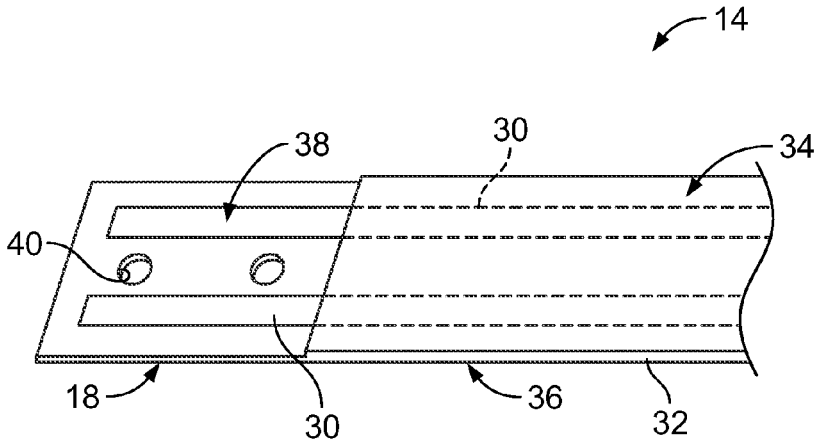
FIG. 2 is a perspective view of a portion of an exemplary embodiment of a ribbon cable of the assembly shown in FIG. 1.

FIG. 2 is a perspective view of a portion of an exemplary embodiment of the ribbon cable 14. The ribbon cable 14 extends a length from the end 18 to an opposite end (not shown). The ribbon cable 14 includes one or more electrical conductors 30 that extend along the length of the cable 14. In the exemplary embodiment, the ribbon cable 14 is a flat flexible cable. A flat flexible cable includes planar electrical conductors that are either embedded within an insulating film base or extend on an exterior surface of the base. When the electrical conductors of a flat flexible cable extend on an exterior surface of the base, the electrical conductors may be exposed, covered and/or separated by corresponding discrete insulators, or covered by a common insulator. Flat flexible cables are sometimes alternatively referred to as "flat flex circuits", "flat flexible conductor cables", "flex cables", "flex circuits", and "flexible flat cables". Flat flexible cables are miniaturized forms of traditional ribbon cables, which typically include insulated cylindrical wires that are aligned in a row and connected together at the insulation layers to define the ribbon structure of the cable. The planar electrical conductors 30 of the ribbon cable 14 are embedded within an insulating film base 32 in the exemplary embodiment. Alternatively, the electrical conductors 30 extend on an exterior surface of the base 32. Moreover, in some alternative embodiments, the electrical conductors 30 are cylindrical insulated wires that are aligned in a row and connected together, such that the ribbon cable 14 is traditional ribbon cable.

In the exemplary embodiment, the electrical conductors 30 of the ribbon cable 14 supply electrical power to the printed circuit board 12 (FIGS. 1 and 9) from a battery (not shown) or other source (not shown) of electrical power that is connected to the end of the cable 14 that is opposite the end 18. Accordingly, the ribbon cable 14 includes two electrical conductors 30 to provide both source and return paths. But, the ribbon cable 14 may include any number of electrical conductors 30. In some alternative embodiments, the electrical conductors 30 of the ribbon cable 14 conduct data signals and/or a shielding ground in addition or alternative to electrical power.

The insulating film base 32 of the ribbon cable 14 includes a pair of opposite sides 34 and 36. In the exemplary embodiment, an end 38 of each of the electrical conductors 30 is exposed at the end 18 of the cable 14 for connection to the corresponding electrical contact 28 (FIGS. 3-9) of the electrical connector 16 (FIGS. 1 and 3-9). The exposed ends 38 optionally define solder pads for connecting the electrical conductors 30 to the electrical contacts 28 using solder. In some alternative embodiments, the end 38 of one or more of the electrical conductors 30 is not exposed at the end 18 of the ribbon cable 14. Rather, in such alternative embodiments, an intervening electrical conductor (such as, but not limited to, a solder pad and/or the like) is exposed at the end 18 of the ribbon cable 14. The intervening electrical conductor is engaged with the end 38 of the corresponding electrical conductor 30 to establish an electrical connection therebetween.

One or more optional alignment holes 40 extend within the end 18 of the ribbon cable 14. The alignment holes 40 receive alignment pegs 42 (FIGS. 3 and 8) of the electrical connector 16 for aligning the connector 16 with the cable end 18. Although two are shown, the end 18 of the ribbon cable 14 may include any number of the alignment holes 40. Because the cable end 18 includes two alignment holes 40, cooperation between the holes 40 and pegs 42 facilitates not only alignment of the location of the electrical connector 16 along the cable end 18 but also alignment of the orientation of the connector 16 relative to the cable end 18. Each alignment hole 40 may include any shape for receiving an alignment peg 42 that includes any shape.

Figure 3:
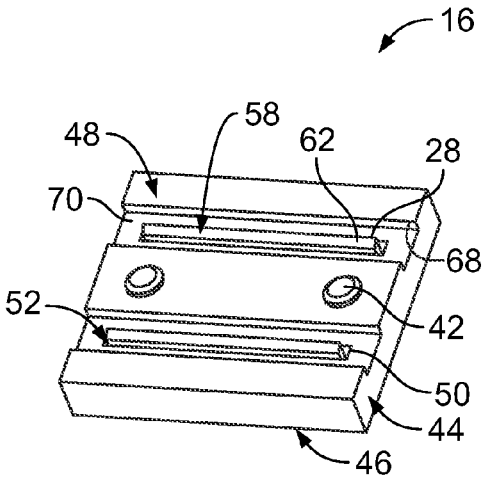
FIG. 3 is a perspective view of an exemplary embodiment of an electrical connector of the assembly shown in FIG. 1.
Figure 4:
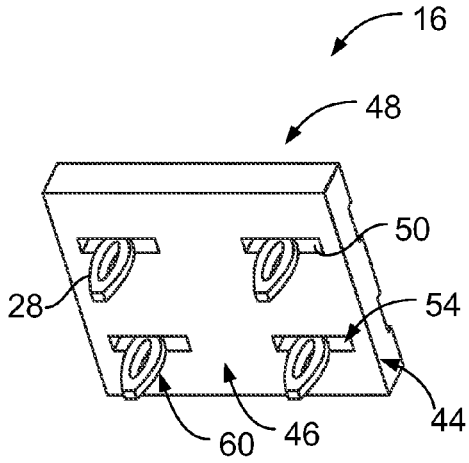
FIG. 4 is a perspective view of the electrical connector shown in FIG. 3 taken from a different angle than FIG. 3.
Figure 5:
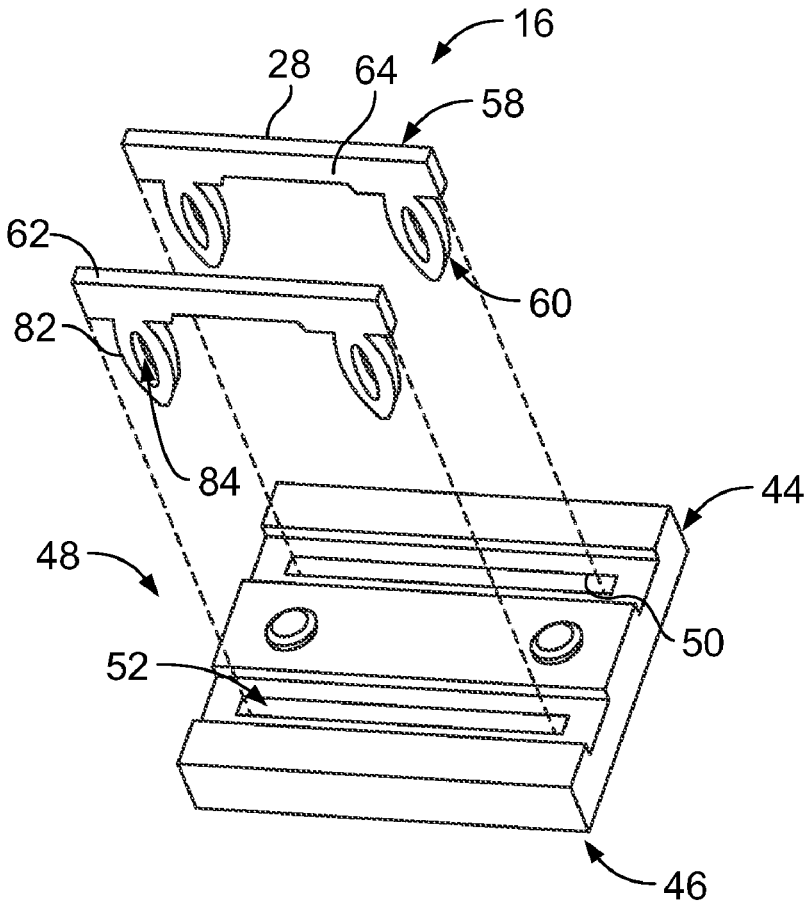
FIG. 5 is an exploded perspective view of the electrical connector shown in FIGS. 3 and 4.

FIG. 3 is a perspective view of an exemplary embodiment of the electrical connector 16. FIG. 4 is a perspective view of the electrical connector 16 taken from a different angle than FIG. 3. FIG. 5 is an exploded perspective view of the electrical connector 16. Referring now to FIGS. 3-5, the electrical connector 16 includes a dielectric body 44 and one or more of the electrical contacts 28 held by the body 44. The body 44 extends from a circuit side 46 to a cable side 48 that is opposite the circuit side 46. The ribbon cable 14 (FIGS. 1, 2, and 7-9) mounts on the cable side 48 of the body 44. The body 44 is configured to be mounted on the printed circuit board 12 (FIGS. 1 and 9) at the circuit side 46. Specifically, when the electrical connector 16 is mounted on the printed circuit board 12, the circuit side 46 of the body faces the side 22 (FIGS. 1 and 9) of the printed circuit board 12.

Figure 6:
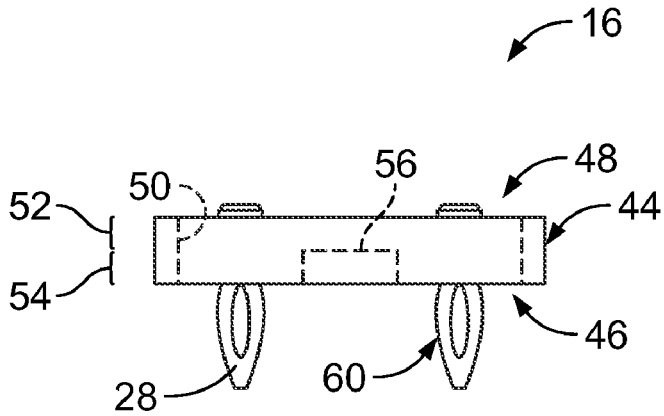
FIG. 6 is a side view of the electrical connector shown in FIGS. 3-5.

The body 44 of the electrical connector 16 includes one or more contact openings 50 for holding the electrical contacts 28. As can be seen in FIGS. 3 and 5, each contact opening 50 includes a bus segment 52 that extends through the cable side 48 of the body 44. As can be seen in FIG. 4, two tail segments 54 of each contact opening 50 extend through the circuit side 46 of the body 44. FIG. 6 is a side view of the electrical connector 16 that better illustrates the contact openings 50. The bus segment 52 extends through the cable side 48 and into the body 44 to a ledge 56. The tail segments 54 extend from the bus segment 52 toward and through the circuit side 46 of the body 44.

Referring again to FIG. 5, the electrical contacts 28 include cable segments 58 and tails 60. The cable segments 58 include connection interfaces 62 at which the electrical contacts 28 electrically and mechanically connect to the ends 38 (FIGS. 2 and 7-9) of the electrical conductors 30 (FIGS. 2 and 7-9) of the ribbon cable 14 (FIGS. 1, 2, and 7-9). In the exemplary embodiment, the connection interfaces 62 are solder pads for connecting the electrical contacts 28 to the electrical conductor ends 38 using solder. The cable segment 58 of each electrical contact 28 includes a bus 64 that electrically and mechanically connects the tails 60 of the electrical contact 28 together.

Figure 9:
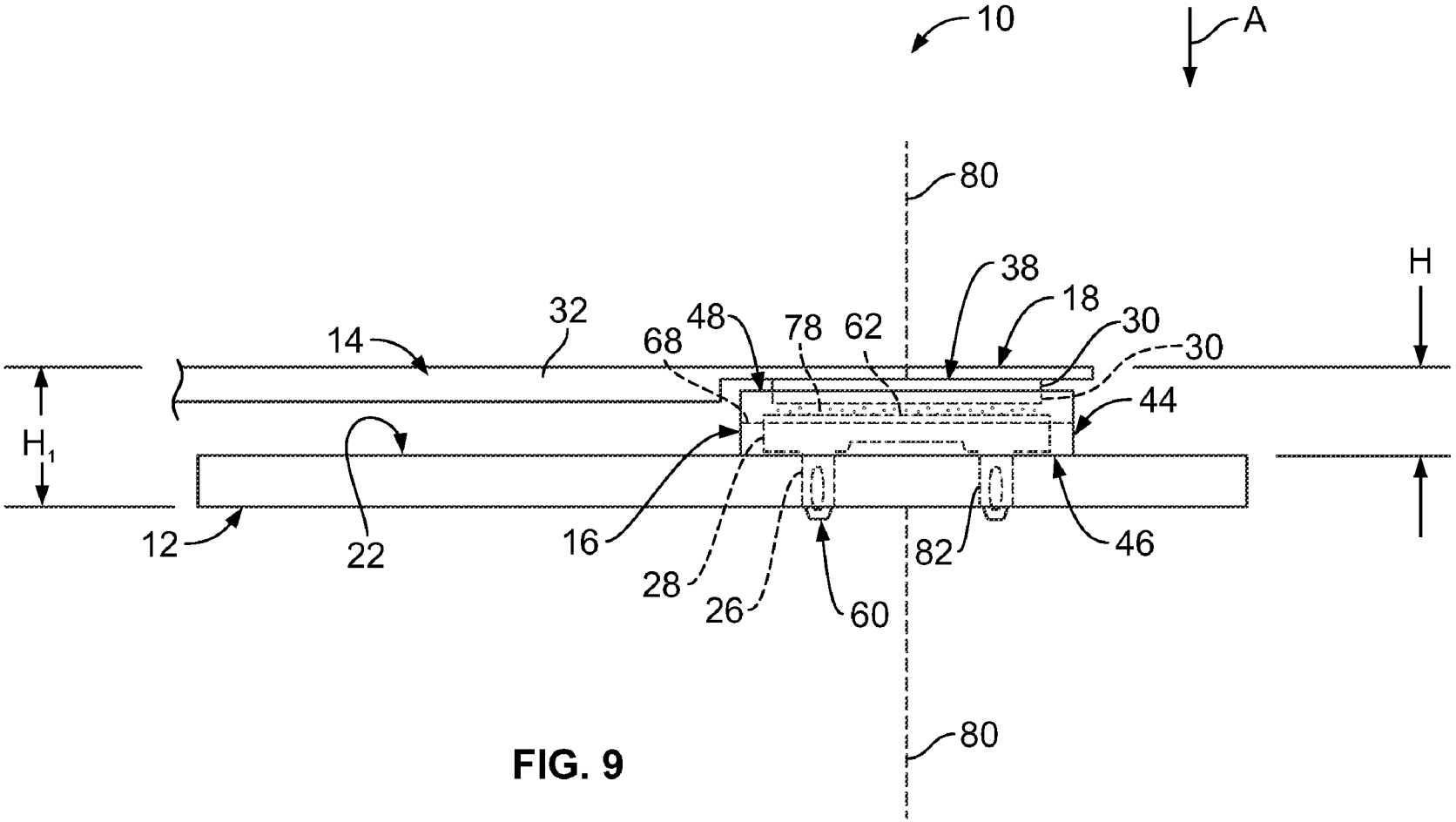
FIG. 9 is a side elevational view of the printed circuit board and cable assembly shown in FIG. 1.

Each of the tails 60 defines a mating interface at which the electrical contacts 28 electrically and mechanically connect to the vias 26 (FIGS. 1 and 9) of the printed circuit board 12 (FIGS. 1 and 9). As will be described below, the tails 60 are configured to be press-fit into the vias 26. The tails 60 thereby define a separable connection between the electrical contacts 28 and the vias 26. In some embodiments, the tails 60 define a semi-permanent connection between the electrical contacts 28 and the vias 26. In the exemplary embodiment, the tails 60 have an eye-of-the needle shape that provides the press-fit between the tails 60 and the vias 26. Specifically, each tail 60 includes opposite deflectable spring arms 82 with an opening 84 extending therebetween. Alternatively, the press-fit between one or more of the tails 60 and the corresponding via 26 is provided by a different shape than the eye-of-the needle shape, such as, but not limited to, a single deflectable spring arm, two or more deflectable spring arms arranged in a different arrangement than eye-of-the needle, and/or the like. Moreover, the separable connection between one or more of the tails 60 and the corresponding via 26 may alternatively be provided by a different configuration than a press-fit configuration. In the exemplary embodiment, each electrical contact 28 includes two tails 60. But, the electrical contacts 28 may each include any number of the tails 60 for reception within any number of the vias 26 of the printed circuit board 12.

As best seen in FIGS. 4 and 6, when the electrical contacts 28 are held by the body 44 within the contact openings 50, the tails 60 project from the circuit side 46 of the body 44. The tails 60 are thus positioned to be received within the vias 26 (FIGS. 1 and 9) when the electrical connector 16 is mated with the printed circuit board 12 (FIGS. 1 and 9). Referring to FIG. 3, the cable segments 58 of the electrical contacts 28 extend along the cable side 48 of the body 44 when the electrical contacts 28 are held within the contact openings 50. Specifically, the connection interfaces 62 of the cable segments 58 extend along the cable side 48 of the body 44. The connection interfaces 62 are thereby positioned to be mechanically and electrically connected to the ends 38 (FIGS. 2 and 7-9) of the electrical conductors 30 (FIGS. 2 and 7-9) of the ribbon cable 14 (FIGS. 1, 2, and 7-9).

Figure 7:
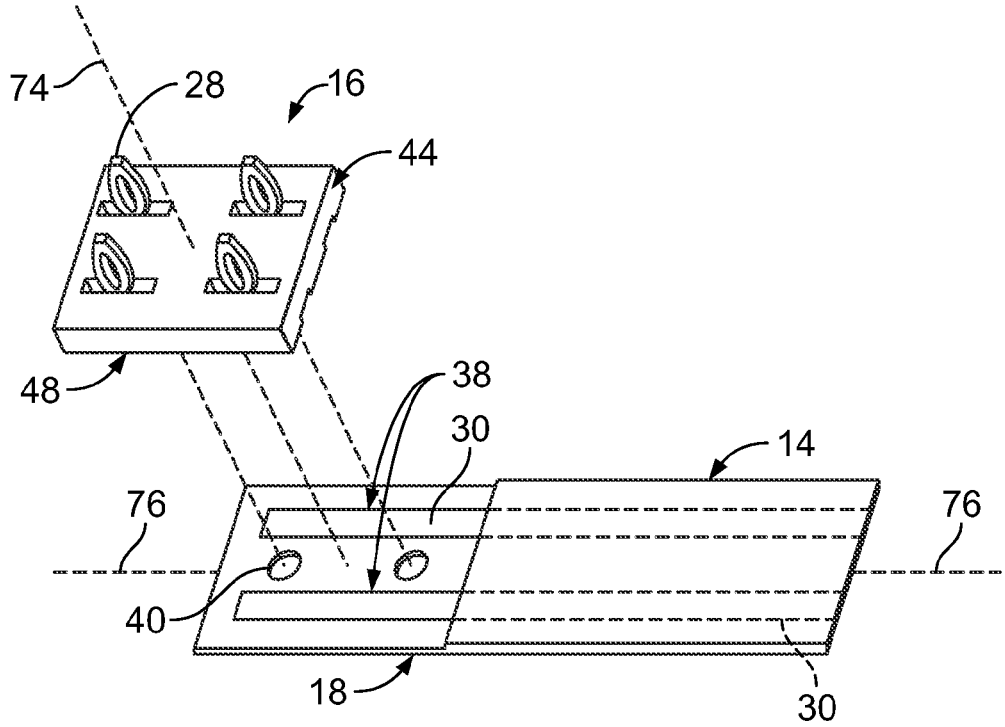
FIG. 7 is a partially exploded perspective view of an exemplary embodiment of an assembly of the ribbon cable shown in FIG. 2 and the electrical connector shown in FIGS. 3-6.
Figure 8:
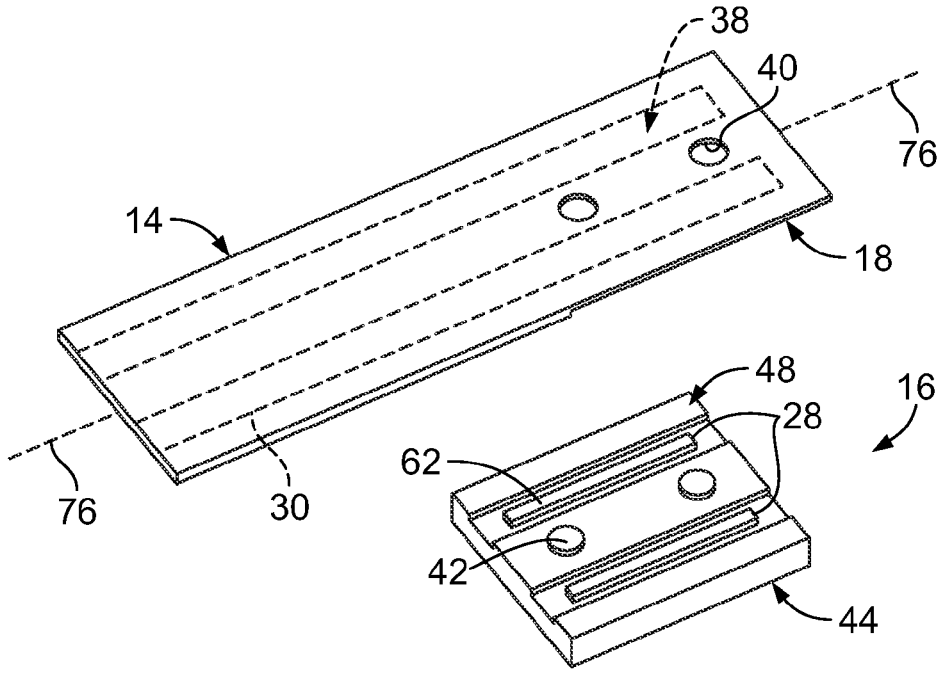
FIG. 8 is another partially exploded perspective view of the assembly shown in FIG. 7 taken from a different angle than FIG. 7.

The body 44 of the electrical connector 16 includes optional grooves 68 that extend into the cable side 48. Each groove 68 extends into the cable side 48 of the body 44 to a bottom wall 70. At the bottom wall 70, the grooves 68 communicate with the bus segments 52 of the contact openings 50. The grooves 68 facilitate exposing the cable segments 58, and more specifically the connection interfaces 62, of the electrical contacts 28 along the cable side 48 of the body 44 for connection to the electrical conductors 30 of the ribbon cable 14. For example, the grooves 68 may facilitate providing a good solder joint by providing surface area on the connection interfaces 62 for solder fillets. Each groove 68 optionally receives the end 38 of the corresponding electrical conductor 30 of the ribbon cable 14 therein. The body 44 also includes the optional alignment pegs 42, which extend outwardly on the cable side 48 of the body 44. The body 44 may include any number of the alignment pegs 42 for being received within any number of alignment holes 40 (FIGS. 2, 7, and 8). Each alignment peg 42 may include any shape for being received within any shape alignment hole 40. Although shown as having two grooves 68 that each have the shape of a parallelepiped, the body 44 may include any number of grooves 68, each of which may include any other shape.

Although shown as having the general shape of a parallelepiped, the body 44 of the electrical connector 16 may additionally or alternatively include any other shape. Portions of the body 44 may be electrically conductive in some alternative embodiments. For example, in some alternative embodiments, one or more exterior surfaces of the body 44 may be coated with an electrically conductive layer. As used herein, the term "dielectric body" is intended to include embodiments wherein a portion of the body 44 (or the body 144 shown in FIGS. 10-12) is electrically conductive.

FIG. 7 is a partially exploded perspective view of an exemplary embodiment of an assembly of the ribbon cable 14 and the electrical connector 16. FIG. 8 is another partially exploded perspective view of the assembly of the ribbon cable 14 and electrical connector 16 taken from a different angle than FIG. 7. Referring now to FIGS. 7 and 8, to connect the electrical connector 16 to the ribbon cable 14 and thereby terminate the end 18 of the ribbon cable 14 with the electrical connector 16, the cable end 18 is aligned with the body 44 of the electrical connector 16. The exposed ends 38 of the electrical conductors 30 on the end 18 of the ribbon cable 14 face the cable side 48 of the body 44. The connection interfaces 62 (not visible in FIG. 7) of the electrical contacts 28 of the electrical connector 16 thereby face the ends 38 of the electrical conductors 30. Each of the alignment holes 40 of the ribbon cable 14 is aligned with the corresponding alignment peg 42 (not visible in FIG. 7) of the electrical connector body 44.

The end 18 of the ribbon cable 14 is mounted on the electrical connector 16 by moving the cable end 18 and the electrical connector 16 toward each other along a connection axis 74 (not shown in FIG. 8). Each alignment peg 42 of the electrical connector 16 is received within the corresponding alignment hole 40 of the ribbon cable 14 to align the end 18 of the ribbon cable 14 with the electrical connector 16. Reception of the alignment pegs 42 within the alignment holes 40 locates the connection interfaces 62 of the electrical contacts 28 of the electrical connector 16 relative to the exposed ends 38 of the electrical conductors 30 along the length of the cable end 18. Specifically, reception of the alignment pegs 42 within the alignment holes 40 locates the connection interfaces 62 relative to the exposed ends 38 along a longitudinal axis 76 of ribbon cable 14. Because more than one pair of cooperating alignment holes 40 and pegs 42 is provided, reception of the alignment pegs 42 within the alignment holes 40 also orients the electrical connector body 44 relative to the end 18 of the ribbon cable 14. For example, the two pairs of cooperating alignment holes 40 and pegs 42 align a rotational position of the electrical connector body 44 about the connection axis 74 with a rotational position of the cable end 18 about the connection axis 74.

FIG. 9 is a side elevational view of the printed circuit board and cable assembly 10. To complete the termination of the ribbon cable 14 by the electrical connector 16, each electrical contact 28 is soldered 78 at the connection interface 62 to the exposed end 38 of the corresponding electrical conductor 30 of the ribbon cable 14 to electrically and mechanically connect the ribbon cable 14 to the electrical connector 16. Each electrical conductor 30 of the ribbon cable 14 is thereby electrically connected to the corresponding electrical contact 28 of the electrical connector 16. In some embodiments, the connection interfaces 62 of the electrical contacts 28 engage the end 38 of the corresponding electrical conductor 30 in addition to being mechanically and electrically connected to the electrical conductor ends 38 via the solder. Alternatively, the connection interfaces 62 do not engage the electrical conductor ends 38. As can be seen in FIG. 9, in the exemplary embodiment, at least a portion of the thickness of each of the electrical conductor ends 38 is received within a corresponding one of the grooves 68 (FIGS. 3 and 9) of the electrical connector body 44. Reception of the electrical conductor ends 38 within the grooves may facilitate reducing a height H of the assembly of the ribbon cable 14 and the electrical connector 16. At the cable end 18, the insulating film base 32 of the ribbon cable 14 is optionally engaged with the cable side 48 of the body 44 of the electrical connector 16. Engagement between the base 32 of the ribbon cable 14 and the cable side 48 of the electrical connector body 44 may facilitate reducing the height H of the assembly of the ribbon cable 14 and the electrical connector 16.

To mount the end 18 of the ribbon cable 14 on the printed circuit board 12, the tails 60 of the electrical contacts 28 are aligned with the vias 26 of the printed circuit board 12. The assembly of the ribbon cable 14 and the electrical connector 16 is then moved along a mating axis 80 toward the side 22 of the printed circuit board 12. Each tail 60 is press-fit within the corresponding via 26 by applying a connection force to the assembly of the ribbon cable 14 and electrical connector 16 in the direction of the arrow A. As each tail 60 is received into the corresponding via 26, the deflectable spring arms 82 of the tail 60 are deflected inwards relative to each other by engagement with the interior wall of the via 26. A return force of the deflectable spring arms 82 may facilitate maintaining an electrical and/or mechanical engagement between the tails 60 and the vias 26. The circuit side 46 of the electrical connector body 44 is optionally engaged with the side 22 of the printed circuit board 12. Engagement between the circuit side 46 of the electrical connector body 44 and the side 22 of the printed circuit board 12 may facilitate reducing a height $H_1$ of the assembly 10.

The tails 60 of the electrical contacts 28 define a separable connection between the electrical contacts 28 and the vias 26. The separable connection between the tails 60 and the vias 26 provides a separable connection between the electrical connector 16 and the printed circuit board 12, which thereby provides a separable connection between the ribbon cable 14 and the printed circuit board 12. Specifically, the ribbon cable 14 can be dismounted from the printed circuit board 12 by removing the tails 60 of the electrical contacts 28 from the vias 26. The tails 60 of the electrical contacts 28 can be removed from the vias 26 without damaging, destroying, and/or the like the vias 26. The separable connection between the electrical contacts 28 and the vias 26 does not form a permanent connection between the electrical contacts 28 and the vias 26. Rather, and for example, a semi-permanent connection may be defined between the electrical contacts 28 and the vias 26. Accordingly, dismounting the end 18 of the ribbon cable 14 from the printed circuit board 12 does not break a permanent connection between the electrical contacts 28 and the vias 26. For example, the end 18 of the ribbon cable 14 can be dismounted from the printed circuit board 12 without having to break a solder joint between the tails 60 and the vias 26. Because the tails 60 of the electrical contacts 28 can be removed from the vias 26 without damaging, destroying, and/or the like the vias 26, the separable connection between the electrical connector 16 and the printed circuit board 12 enables the printed circuit board 12 to be reused after the ribbon cable 14 has been dismounted from the printed circuit board 12.

Figure 10:
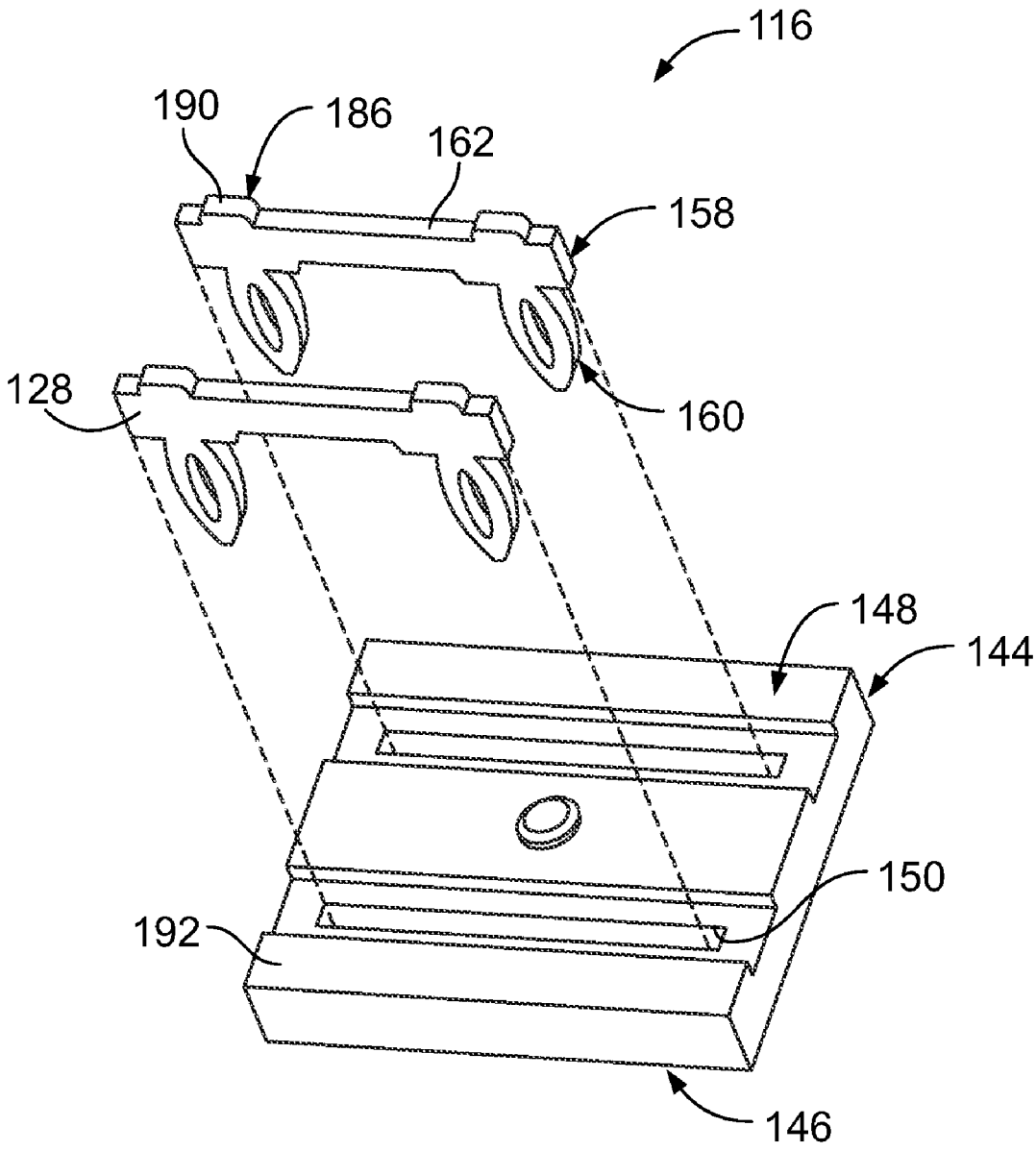
FIG. 10 is an exploded perspective view of an exemplary alternative embodiment of an electrical connector.

FIG. 10 is an exploded perspective view of an exemplary alternative embodiment of an electrical connector 116. The electrical connector 116 includes a dielectric body 144 and one or more electrical contacts 128 held by the body 144. The body 144 extends from a circuit side 146 to a cable side 148 that is opposite the circuit side 46. The body 144 of the electrical connector 116 includes one or more contact openings 150 for holding the electrical contacts 128.

Figure 12:
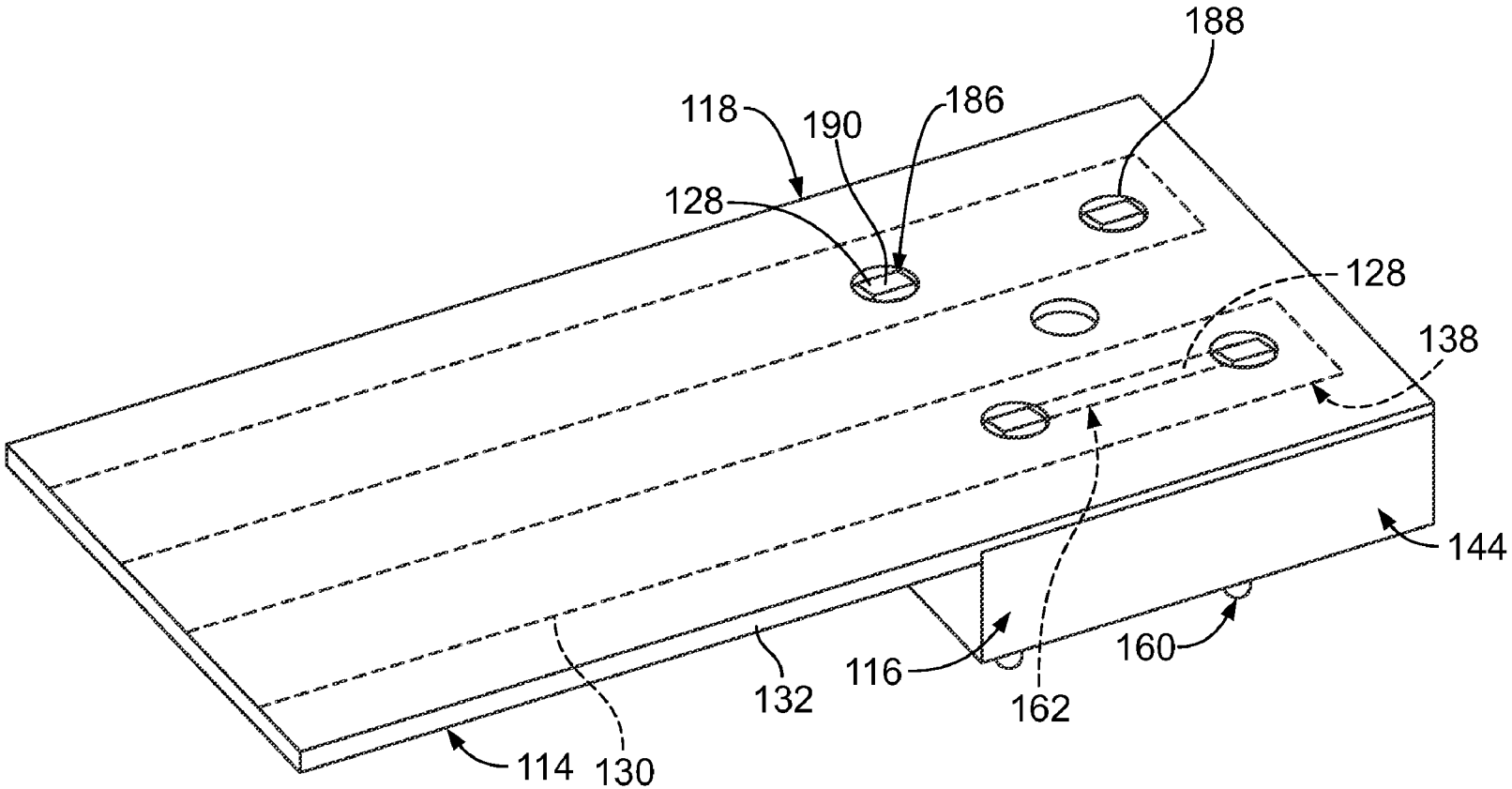
FIG. 12 is a perspective view of an exemplary embodiment of an assembly of an exemplary alternative embodiment of a ribbon cable and the electrical connector shown in FIGS. 10 and 11.

The electrical contacts 128 include cable segments 158 and tails 160. The cable segments 158 include connection interfaces 162 at which the electrical contacts 128 electrically and mechanically connect to the ends 138 (FIG. 12) of electrical conductors 130 (FIG. 12) of a ribbon cable 114 (FIG. 12). In the exemplary embodiment, the connection interfaces 162 are solder pads for connecting the electrical contacts 128 to the electrical conductor ends 138 using solder. Each of the tails 160 defines a mating interface at which the electrical contacts 128 electrically and mechanically connect to the vias 26 (FIGS. 1 and 9) of the printed circuit board 12 (FIGS. 1 and 9). The tails 160 define a separable connection between the electrical contacts 128 and the vias 26.

Figure 11:
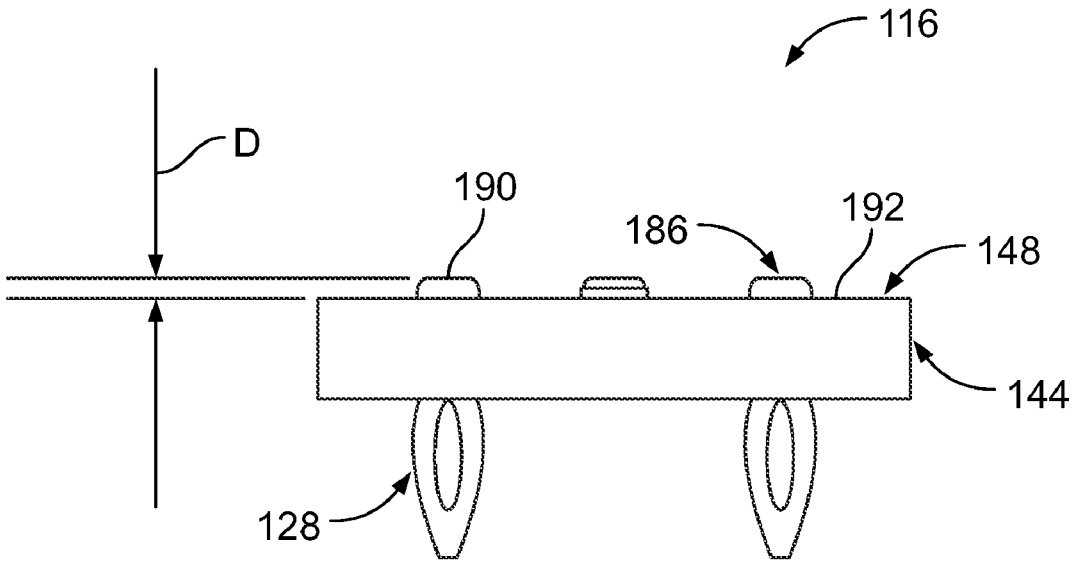
FIG. 11 is a side elevational view of the electrical connector shown in FIG. 10.

The connection interfaces 162 of the cable segments 158 of the electrical contacts 128 extend along the cable side 148 of the body 144 when the electrical contacts 128 are held within the contact openings 150. The cable segments 158 of the electrical contacts 28 include nubs 186 that project outwardly from the connection interfaces 162. As described below, each nub 186 is received within a corresponding hole 188 (FIG. 12) of the ribbon cable 114. Each nub 186 includes a pressing surface 190. When the electrical contacts 128 are held within the contact openings 150, the nubs 186 project beyond the cable side 148 of the body 144 of the electrical connector 116. Specifically, FIG. 11 is a side elevational view of the electrical connector 116. The cable side 148 of the body 144 of the electrical connector 116 includes an exterior surface 192. The nubs 186 project beyond the cable side 148 of the electrical connector body 144 such that the pressing surfaces 190 of the nubs 186 are spaced apart from the exterior surface 192 of the cable side 148 by a distance D. Although each electrical contact 128 is shown as including two nubs 186, each electrical contact 128 may include any number of the nubs 186 for reception within any number of holes 188 (FIG. 12).

FIG. 12 is a perspective view of an exemplary embodiment of an assembly of an exemplary alternative embodiment of a ribbon cable 114 and the electrical connector 116. The ribbon cable 114 includes an end 118. Electrical conductors 130 are embedded within an insulating film base 132 of the ribbon cable 114. An end 138 of each of the electrical conductors 130 is electrically connected to the connection interface 162 of the corresponding electrical contact 128 of the electrical connector 116.

One or more optional nub holes 188 extend within the end 118 of the ribbon cable 114. As can be seen in FIG. 12, the nubs 186 of the electrical contacts 128 are received within the nub holes 188 such that the pressing surfaces 190 of the nubs 186 are exposed. The pressing surfaces 190 of the nubs 186 are used to mount the end 118 of the ribbon cable 114 on the printed circuit board 12 (FIGS. 1 and 9). Specifically, a connection force exerted on the assembly to mate the electrical connector 116 with the printed circuit board 12 can be applied to the pressing surfaces 190 of the nubs 186 to insert the tail 160 of each electrical contact 128 into the corresponding via 26 (FIGS. 1 and 9). Because the connection force is applied directly to the nubs 186, the connection force is not applied to the joints between the electrical conductors 130 and the connection interfaces 162 of the electrical contacts 128. Accordingly, the nubs 186 may facilitate preventing mechanical and/or electrical disconnection of the electrical contacts 128 from the electrical conductors 130 when the electrical connector 116 is mated with the printed circuit board 12. Although four are shown, the end 118 of the ribbon cable 114 may include any number of the nub holes 188. In some alternative embodiments, the ribbon cable 114 does not include the nub holes 188 and the connection force is applied to the pressing surfaces 190 of the nubs 186 through the insulating film base 132 of the ribbon cable 114.

As used herein, the term "printed circuit board" is intended to mean any electric circuit in which the conducting connections have been printed or otherwise deposited in predetermined patterns on an electrically insulating substrate. The substrate 20 of the printed circuit board 12 may be a flexible substrate or a rigid substrate. The substrate 20 may be fabricated from and/or include any material(s), such as, but not limited to, ceramic, epoxy-glass, polyimide (such as, but not limited to, Kapton® and/or the like), organic material, plastic, polymer, and/or the like. In some embodiments, the substrate 20 is a rigid substrate fabricated from epoxy-glass, such that the printed circuit board 12 is what is sometimes referred to as a "circuit board".

The embodiments described and/or illustrated herein may provide an electrical connector that provides a separable connection between a ribbon cable and a printed circuit board while having a reduced height relative to at least some known electrical connectors systems.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the above description and the drawings. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector and cable assembly for mounting on a printed circuit board, said assembly comprising:

a ribbon cable having an end that includes an electrical conductor; and an electrical connector comprising:

a dielectric body comprising a circuit side, a cable side that is opposite the circuit side, and a contact opening that extends through the body; and an electrical contact comprising a cable segment and a tail extending from the cable segment, the electrical contact being held within the contact opening such that at least a portion of the cable segment extends along the cable side of the body and at least a portion of the tail projects from the circuit side of the body, the cable segment being electrically connected to the electrical conductor of the ribbon cable, wherein the tail is configured to be separably mated with the printed circuit board.

2. The assembly according to claim 1, wherein the printed circuit board includes a via, the tail of the electrical contact being configured to be press-fit into the via of the printed circuit board.

3. The assembly according to claim 1, wherein the cable segment of the electrical contact is soldered to the electrical conductor of the ribbon cable.

4. The assembly according to claim 1, wherein the end of the ribbon cable comprises a hole extending therein, the cable segment of the electrical contact comprises a nub that projects beyond the cable side of the body for extending through the hole provided in the ribbon cable.

5. The assembly according to claim 1, wherein the body of the electrical connector is sandwiched between the end of the ribbon cable and the printed circuit board when the assembly is mounted on the printed circuit board.

6. The assembly according to claim 1, wherein the electrical contact is separable from the body of the electrical connector.

7. The assembly according to claim 1, wherein the cable segment of the electrical contact comprises a nub that projects beyond the cable side of the body, the end of the ribbon cable comprising a hole extending therein, the nub of the cable segment of the electrical contact being received within the hole, the nub comprising a pressing surface configured to receive a connection force for mounting the assembly on the printed circuit board.

8. The assembly according to claim 1, wherein the electrical conductor of the ribbon cable comprises a solder pad.

9. The assembly according to claim 1, wherein the tail is a first tail and the cable segment comprises a bus, the electrical contact further comprising a second tail extending from the cable segment, the second tail being configured to be separably mated with the printed circuit board, the first and second tails being mechanically and electrically connected together via the bus.

10. The assembly according to claim 1, wherein the body of the electrical connector comprises an alignment peg that extends outwardly on the cable side of the body, the end of the ribbon cable comprising an alignment hole, the alignment peg of the body being received within the alignment hole of the ribbon cable.

11. The assembly according to claim 1, wherein the ribbon cable is a flat flexible cable.

12. A printed circuit board and cable assembly comprising:

a printed circuit board;

a ribbon cable having an end that includes an electrical conductor; and an electrical connector comprising:

a dielectric body comprising a circuit side, a cable side that is opposite the circuit side, and a contact opening that extends through the body, the end of the ribbon cable being mounted on the cable side of the body, the body being mounted on the printed circuit board at the circuit side; and an electrical contact held within the contact opening of the body, the electrical contact comprising a cable segment and a tail extending from the cable segment, the cable segment being electrically connected to the electrical conductor of the ribbon cable, the tail being separably mated with the printed circuit board.

13. The assembly according to claim 12 wherein the printed circuit board comprises a via, the tail of the electrical contact being press-fit into the via of the printed circuit board.

14. The assembly according to claim 12, wherein the cable segment of the electrical contact comprises a nub that projects beyond the cable side of the body, the end of the ribbon cable comprising a hole extending therein, the nub of the cable segment of the electrical contact being received within the hole.

15. The assembly according to claim 12, wherein the cable segment of the electrical contact is soldered to the electrical conductor of the ribbon cable.

16. The assembly according to claim 12, wherein the body of the electrical connector is sandwiched between the end of the ribbon cable and the printed circuit board.

17. The assembly according to claim 12, wherein the electrical contact is separable from the body of the electrical connector.

18. The assembly according to claim 12, wherein the body of the electrical connector comprises an alignment peg that extends outwardly on the cable side of the body, the end of the ribbon cable comprising an alignment hole, the alignment peg of the body being received within the alignment hole of the ribbon cable.

19. The assembly according to claim 12, wherein the ribbon cable is a flat flexible cable.

* * * * *